US008128177B2

(12) United States Patent
Menzenbach et al.

(10) Patent No.: US 8,128,177 B2
(45) Date of Patent: Mar. 6, 2012

(54) ADAPTIVE ADVANCE DRIVE CONTROL FOR MILLING MACHINE

(75) Inventors: Christoph Menzenbach, Neustadt/Wied (DE); Axel Mahlberg, Hennef (DE); Herbert Lange, Overath (DE); Cyrus Barimani, Konigswinter (DE); Gunter Hahn, Konigswinter (DE)

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 12/701,812

(22) Filed: Feb. 8, 2010

(65) Prior Publication Data

US 2011/0193397 A1 Aug. 11, 2011

(51) Int. Cl.
*E01C 23/26* (2006.01)

(52) U.S. Cl. ..... 299/1.5

(58) Field of Classification Search ..... 299/1.5, 299/1.05, 1.4

See application file for complete search history.

(56) References Cited

U.S. PATENT DOCUMENTS

| | | | | |
|---|---|---|---|---|
| 4,343,513 | A * | 8/1982 | Godbersen | 299/1.5 |
| 4,929,121 | A * | 5/1990 | Lent et al. | 299/1.5 |
| 5,318,378 | A * | 6/1994 | Lent | 404/90 |
| 5,879,056 | A | 3/1999 | Breidenbach | |
| 6,170,341 | B1 | 1/2001 | Avitan | |
| 6,338,281 | B1 | 1/2002 | El-Ibiary et al. | |
| 6,407,475 | B1 | 6/2002 | Care | |
| 7,422,391 | B2 | 9/2008 | Holl et al. | |
| 2008/0150347 | A1 * | 6/2008 | Moller et al. | 299/1.5 |
| 2008/0199117 | A1 | 8/2008 | Joki | |

OTHER PUBLICATIONS

Exhibit A: Brochure re Model DA 120 available from ME-Messysteme GmbH of Hennigsdorf, Germany.

* cited by examiner

*Primary Examiner* — John Kreck
(74) *Attorney, Agent, or Firm* — Waddey & Patterson, P.C.; Lucian Wayne Beavers

(57) ABSTRACT

An adaptive advance control system for a construction machine senses the reaction forces applied by the ground surface to a milling drum, and in response to the sensed changes in those reaction forces controls the motive power applied to an advance drive of the machine. Early and rapid detection of such changes in reaction forces allow the control system to aid in preventing lurch forward events of the construction machine.

30 Claims, 8 Drawing Sheets

ADAPTIVE ADVANCE DRIVE CONTROL FOR MILLING MACHINE

BACKGROUND OF THE INVENTION

1. Field of the Invention

The present invention relates generally to drive control systems for construction machines of the type including a milling drum, such as for example milling machines, surface miners or stabilizer/recycler machines. An adaptive advance drive control system for such machines aids in the prevention of lurch forward events when the machine is operating in a down cut mode.

2. Description of the Prior Art

During the normal operation of a construction machine having a milling drum, it is desirable that the operator be able to maintain control over the forward or rearward motion of the machine, regardless of the operation of the milling drum. If the reaction forces exerted by the ground surface on the milling drum exceed the control forces applied to the milling drum by the weight, motive force and braking force of the construction machine, then a lurch forward or lurch backward event of the construction machine may occur. If the construction machine is operating in a down cut mode the reaction forces on the rotating milling drum may cause the construction machine to lurch forward, or if the rotating milling drum is operating in an up cut mode, the reaction forces on the milling drum may cause the construction machine to lurch back. And if the machine is in the process of being lowered too fast into the cut the reaction force on the rotating milling drum may cause the construction machine to lurch forward or backward depending on the cutting mode, i.e. at down-cut mode or up-cut mode.

Prior art systems have typically dealt with such undesirable events by detecting the event after its occurrence and then shutting down the operating systems of the machine. Examples are seen in U.S. Pat. No. 4,929,121 to Lent et al.; U.S. Pat. No. 5,318,378 to Lent; and U.S. Pat. No. 5,879,056 to Breidenbach.

There is a continuing need for improved systems for maintaining control of construction machines having milling drums, and particularly for reducing or altogether eliminating the occurrence of lurch forward or lurch backward events.

SUMMARY OF THE INVENTION

In one embodiment a method is provided for controlling a construction machine having a frame, a milling drum supported from the frame for milling a ground surface, a plurality of ground engaging supports engaging the ground surface and supporting the frame, and an advance drive associated with at least one of the ground engaging supports to provide motive power to the at least one ground engaging support. Motive power is applied to the advance drive and moves the construction machine forward at an advance speed. The milling drum is operated in a down cut mode. A parameter is sensed corresponding to a reaction force acting on the milling drum. A change in the parameter is detected corresponding to an increase in the reaction force. In response to detecting the change and while continuing to operate the milling drum in a down cut mode, the motive power provided to the advance drive is reduced to reduce the advance speed and thereby reduce the reaction force to prevent a lurch forward event.

In another embodiment a method is provided for controlling a construction machine having a frame and a milling drum supported from the frame for milling a ground surface.

The milling drum is rotated. The rotating milling drum is lowered relative to the ground surface. A parameter corresponding to a reaction force acting on the milling drum is sensed. A change in the parameter corresponding to an increase in the reaction force is detected. In response to detecting the change and while continuing to rotate the milling drum, a rate of lowering the milling drum is slowed thereby preventing a lurch forward or lurch backward event.

In another embodiment a construction machine comprises a frame, and a milling drum supported from the frame for milling a ground surface. The milling drum is constructed to operate in a down cut mode. A plurality of ground engaging supports support the frame from the ground surface. An advance drive is associated with at least one of the ground engaging supports to provide motive power to advance the construction machine across the ground surface. A sensor is arranged to detect a parameter corresponding to a reaction force from the ground surface acting on the milling drum. An actuator is operably associated with the advance drive for controlling the motive power output by the advance drive. A controller is connected to the sensor to receive an input signal from the sensor and connected to the actuator to send a control signal to the actuator. The controller includes an operating routine which detects a change in the sensed parameter corresponding to an increase in reaction force and in response to the change reduces motive power provided to the advance drive to aid in preventing a lurch forward event of the construction machine.

In another embodiment a construction machine comprises a frame, and a milling drum supported from the frame for milling a ground surface. A plurality of ground engaging supports support the frame from the ground surface. A sensor is arranged to detect a parameter corresponding to a reaction force from the ground surface acting on the milling drum. An actuator is operably associated with the advance drive for controlling a rate at which the milling drum is lowered into the ground surface. A controller is connected to the sensor to receive an input signal from the sensor and connected to the actuator to send a control signal to the actuator. The controller includes an operating routine which detects a change in the sensed parameter corresponding to an increase in reaction force and in response to the change reduces the rate at which the milling drum is lowered to aid in preventing a lurch forward or lurch backward event of the construction machine.

Numerous objects, features and advantages of the present invention will be readily apparent to those skilled in the art upon a reading of the following disclosure when taken in conjunction with the accompanying drawings.

DETAILED DESCRIPTION OF THE INVENTION

Figure 1:
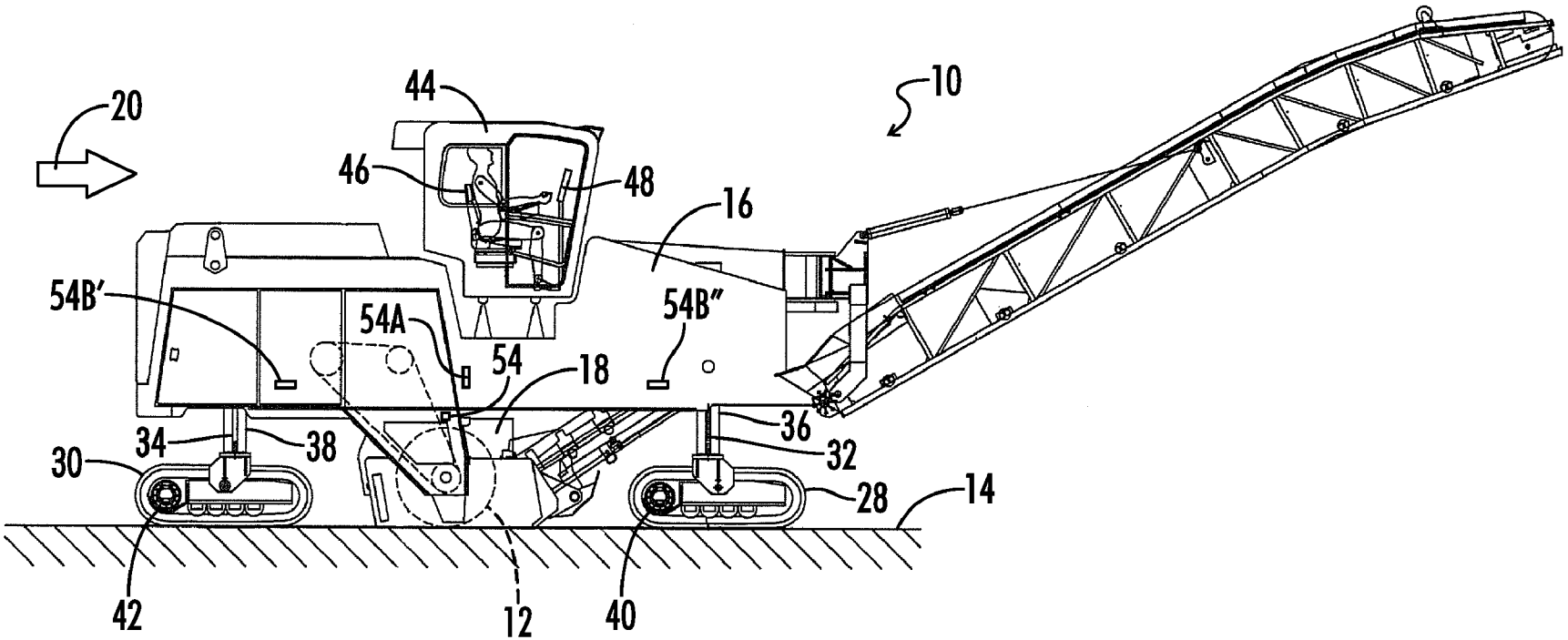
FIG. 1 is a side elevation view of a construction machine.

FIG. 1 shows a side elevation view of a construction machine generally designated by the numeral 10. The construction machine 10 illustrated in FIG. 1 is a milling machine. The construction machine 10 may also be a stabilizer/recycler or other construction machine of the type including a milling drum 12. The milling drum 12 is schematically illustrated in FIG. 2 in engagement with a ground surface 14.

The construction machine 10 of FIG. 1 includes a frame 16 and a milling drum housing 18 attached to the frame 16. The milling drum 12 is rotatably supported within the milling drum housing 18.

Figure 2:
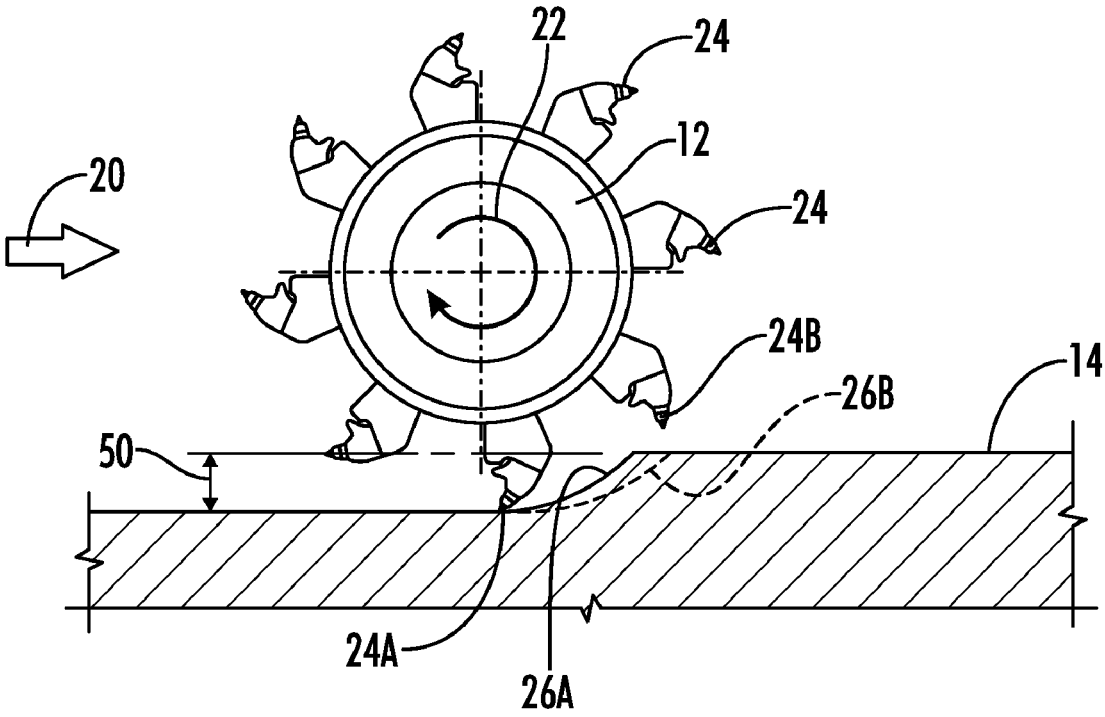
FIG. 2 is a side elevation schematic view showing a milling drum operating in a down cut mode.

The milling drum 12 of FIG. 2 is shown schematically operating in a down cut mode. In the down cut mode, the construction machine 10 is moving forward from left to right in the direction indicated by the arrow 20 of FIGS. 1 and 2. The milling drum 12 is rotating clockwise as indicated by arrow 22. The milling drum 12 has a plurality of cutting tools 24 mounted thereon. Each of the cutting tools 24 in turn engages the ground surface 14 and cuts a downward arc-shaped path such as 26 through the ground surface. In the schematic illustration of FIG. 2, the cutting tool 24A has just finished cutting the arc-shaped path 26A. The next cutting tool 24B is about to engage the ground surface and will cut the next arc-shaped path 26B which is shown in dashed lines. FIG. 2 is schematic only, and as will be understood by those skilled in the art, the drum 12 actually has a great many cutting tools attached thereto over its width, and in any cross-section of the drum in the direction of travel only one or two cutting tools will actually be present. However, across the width of the drum 12 as many as thirty cutting tools may engage the ground at any one time.

It is noted that the forces applied to the ground surface 14 by the cutting drum 12 drive the construction machine 10 forward in the same direction as which the construction machine drum is moving.

Referring to FIG. 1, the construction machine 10 includes a plurality of ground engaging supports such as 28 and 30. The ground engaging supports 28 and 30 are sometimes also referred to as running gears, and may either be endless tracks as shown or they may be wheels and tires. The construction machine 10 may include one or more forward ground engaging supports 28 and one or more rearward ground engaging supports 30. As will be understood by those skilled in the art the construction machine 10 typically has three or four such ground engaging supports. Each ground engaging support such as 28 or 30 is attached to the lower end of a hydraulic ram such as 32 or 34 so as to support the frame 16 from the ground 14 in an adjustable manner. The rams 32 and 34 are contained in telescoping housings 36 and 38 which allow the elevation of the frame 16 to be adjusted relative to the ground surface 14.

One or more of the ground engaging supports 28 and 30 will have an advance drive such as 40 or 42 associated therewith to provide motive power to advance the construction machine 10 across the ground surface 14. The advance drives 40 and 42 may be hydraulic drives or electric drives or any other suitable advance drive mechanism.

The construction machine 10 includes a cab 44 or operator stand in which a human operator may sit in a operator's chair 46 or stand to control the operation of the construction machine 10 from control station 48.

In general, construction machines including milling drums may operate in either a down cut mode as schematically illustrated in FIG. 2, or an up cut mode in which the milling drum rotates in the opposite direction. Of course if operating in an up cut mode, the inclination of the cutting teeth 24 would be reversed. It is noted that the concept of operation in a down cut mode or an upcut mode is related to the direction of rotation of the ground engaging supports. If the drum is rotating in the same direction that the ground engaging supports (wheels or tracks) are rotating, the machine is operating in a down cut mode. If the drum is rotating in the opposite direction from that of the ground engaging supports the machine is operating in the up cut mode. A machine such as that shown in FIG. 1 which operates in the down cut mode when moving in the forward direction will operate in the up cut mode if moved in the reverse direction. Operation in the up cut mode is sometimes referred to in the industry as "conventional milling", whereas operation in the down cut mode is sometimes referred to as "climb milling".

Either the up cut or the down cut mode may be utilized by various construction machines for different working situations. In one type of construction machine known as a stabilizer/recycler machine, the ground surface is milled and the milled material is immediately spread and then recompacted. In such stabilizer/recycler machines a down cut mode of operation is preferable because it tends to result in smaller particles of ground up road material than does an up cut mode.

To begin operation of a cutting sequence with the construction machine 10 operating in a down cut mode as illustrated in FIG. 2, the construction machine is moved to the desired starting location with the milling drum 12 held at an elevated location above the ground surface 14. For a milling machine, the elevation of the milling drum 12 relative to the ground surface is usually controlled by extension and retraction of the hydraulic rams such as 32 and 34. For a stabilizer/recycler machine, the elevation of the milling drum 12 relative to the ground surface is usually controlled by hydraulic rams which lower the drum relative to the frame of the machine. The milling drum 12 is rotated in the direction 22 as illustrated in FIG. 2. The speed of rotation of milling drum 12 is typically a constant speed on the order of about 100 rpm which is determined by the operating speed of a primary power source of the machine 10, typically a diesel engine, and the drive train connecting that power source via a clutch to the milling drum, typically a V-belt and pulley arrangement driving a gear reducer contained within the milling drum 12. The rotating milling drum is then lowered relative to the ground surface 14 until the cutting tools 24 begin cutting the ground surface 14. The rotating drum continues to be slowly lowered to a desired milling depth. Then the construction machine 10 is moved forward in the direction 20 by application of motive power to the advance drives such as 40 and 42.

The depth of the cut made by the milling drum 12 is typically controlled by a profile control system which monitors a reference line such as a guide string or a guide path on the ground and which maintains a desired elevation of the cut of the milling drum 12. The advance speed of the apparatus 10 may be controlled by the human operator located on the cab 44, and may include the setting of a set point of desired advance speed into a control system.

One problem which is sometimes encountered in the use of a construction machine 10 operating in the down cut mode as illustrated in FIG. 2 is an uncontrolled "lurch forward" event in which the power being applied to the milling drum 12 may cause the milling drum 12 to ride up out of the cut and onto the ground surface 14 so that the milling drum actually drives the machine 10 forward. Such a lurch forward event may occur due to the fact that the velocity of the milling drum surface is several times as much as the velocity of the wheels or tracks which power the machine.

The operation of the milling drum 12 may be described as a function of the reaction force exerted by the ground surface 14 upon the milling drum 12. The reaction force may be considered to have a vertical component and a horizontal component. The vertical component of the reaction force is primarily due to that portion of the total weight of the construction machine 10 which is supported by the engagement of the milling drum 12 with the ground surface 14. The horizontal component of the reaction force is primarily due to the advance drive moving the drum forward into the ground. Some embodiments of the invention described herein focus primarily upon the vertical component of the reaction force, but the invention is not limited to sensing solely the vertical component.

Prior to engagement of the milling drum 12 with the ground surface 14, when the milling drum 12 is held above the ground surface 14, the reaction force is equal to zero. The entire weight of the construction machine 10 is supported by the various ground engaging supports such as 28 and 30. As the milling drum 12 is lowered into engagement with the ground surface 14, some portion of that weight of the construction machine 10 is actually carried by the milling drum 12, and thus the vertical load carried by the various ground engaging supports such as 28 and 30 is reduced by the amount of that load being carried by the milling drum 12. If the hydraulic rams 32 and 34 were retracted to the point where the ground engaging supports 28 and 30 were lifted entirely off the ground and the entire machine were resting on the milling drum 12, then the vertical component of the reaction force would be equal to 100% of the weight of the construction machine. Thus, during operation of the apparatus 10 with the milling drum 12 engaging the ground surface, the vertical component of the reaction force will be somewhere between zero and 100% of the weight of the construction machine. A number of factors contribute to this reaction force. These contributing factors include, among others:

1. The condition of the cutting tools 24, i.e. whether they are new or worn;
2. The hardness of the material of the ground surface 14 being cut;
3. The advance speed at which the machine 10 moves forward in the direction 20; and
4. The milling depth 50 at which the milling drum is cutting into the ground surface 14.

Another factor that comes into play when the milling drum 12 is first being lowered into engagement with the ground surface 14 is the lowering speed at which the rotating milling drum 12 is lowered into the ground surface 14. These various factors affect the reaction force and the likelihood of unexpected "lurch forward" or "lurch backward" events as follows.

Regarding the condition of the cutting tools 24, if the cutting tools are new and sharp the reaction force is lower, and as the cutting tools become more worn, the reaction force increases.

Regarding the hardness of the material of the ground surface 14, the harder the material, the higher the reaction force upon the milling drum 12. If the machine 10 unexpectedly encounters ground material of increased hardness, the machine may unexpectedly lurch forward.

Regarding the advance speed, higher advance speeds cause higher reaction forces upon the milling drum 12. Furthermore, the closer the advance speed is to the peripheral tip speed of the cutting tools 24, the higher the risk of a lurch forward event.

With regard to milling depth, deeper milling depths result in higher reaction forces. But, the contribution of milling depth to the reaction force is actually contrary to the effect on the likelihood of lurch forward events. Although reaction forces are increased with deeper milling depths, for increased milling depths the milling drum must climb up out of the depth of the cut in order for a lurch forward event to occur. For deeper cuts it is harder for the milling drum to climb up out of the cut, and thus deeper cuts may lead to a lower likelihood of a lurch forward event.

Figure 5:
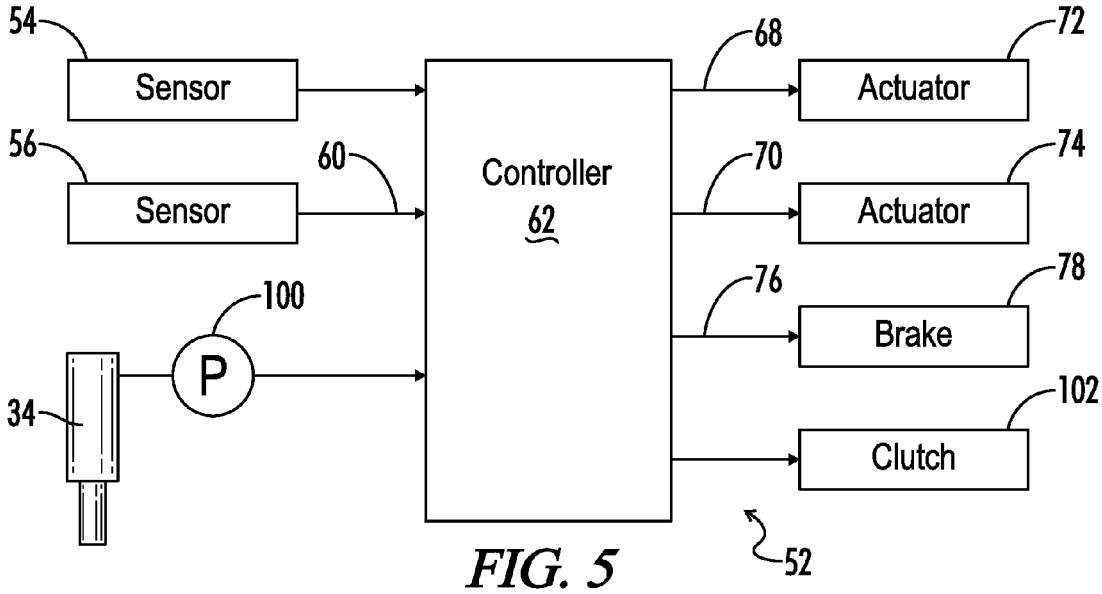
FIG. 5 is a schematic illustration of the control system.

The apparatus 10 includes an adaptive advance drive control system 52 schematically illustrated in FIG. 5 which monitors this reaction force acting upon the milling drum 12 and aids in preventing lurch forward events by controlling one or more of the factors contributing to the reaction force.

During normal operation of the construction machine 10, the factor discussed above most readily controlled is the advance speed, and thus in one embodiment of the adaptive advance drive control system 52, the motive power provided to the advance drives 40 and 42 is controlled in response to the monitored reaction force on the milling drum 12.

In another embodiment, when the rotating milling drum 12 is first being lowered into engagement with the ground surface 14, the reaction force may be controlled by controlling the speed of lowering of the milling drum into the ground surface.

Figure 3:
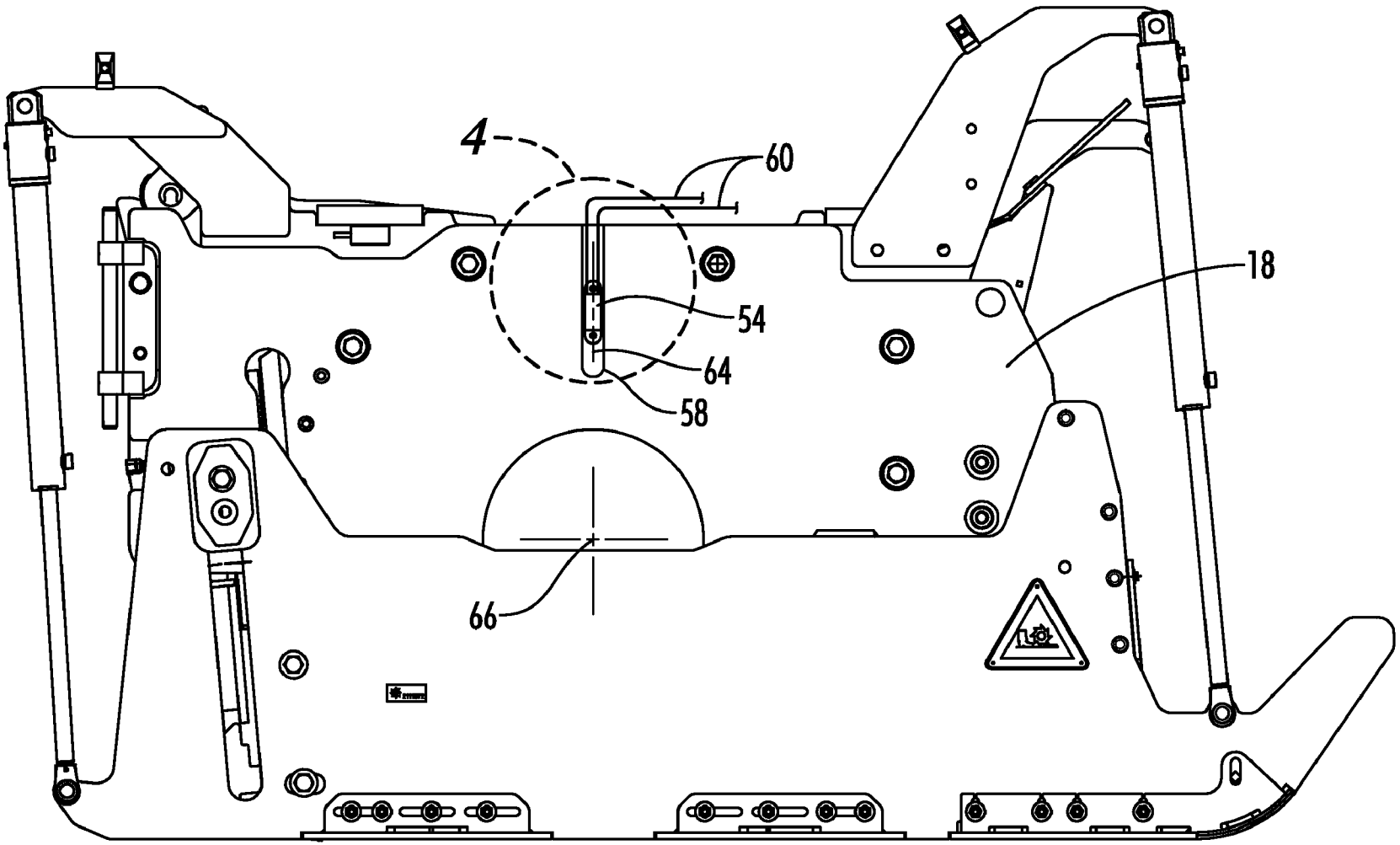
FIG. 3 is a side elevation view of the milling drum housing of the construction machine of FIG. 1 and illustrating a location of a strain gage sensor element on the milling drum housing above the rotational axis of the milling drum.
Figure 4:
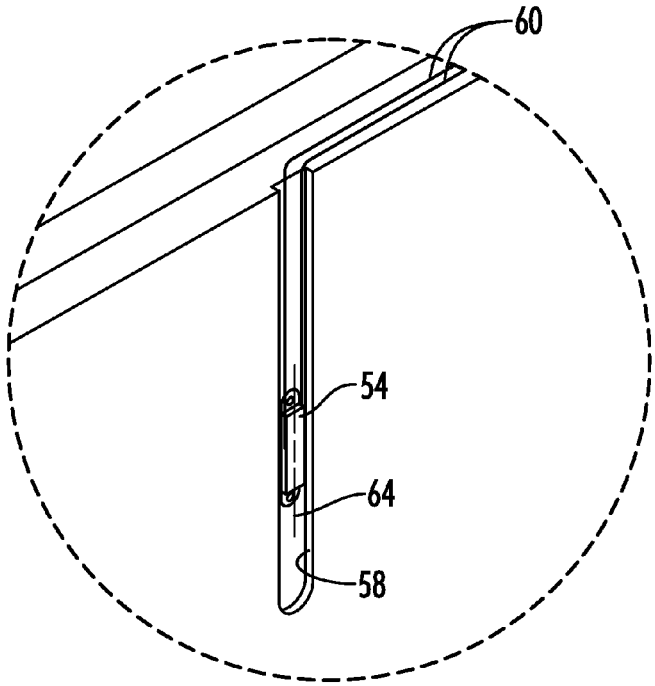
FIG. 4 is an enlarged view of the strain gage mounted in the milling drum housing of FIG. 3.

The control system 52 includes at least one sensor 54 and preferably a pair of sensors 54 and 56 arranged to detect a parameter corresponding to a reaction force from the ground surface 14 acting on the milling drum 12. In the embodiment illustrated in FIGS. 3 and 4, the sensors 54 and 56 are strain gages mounted on opposite side walls of the milling drum housing 18. In FIGS. 3 and 4 the first strain gage sensor 54 is shown mounted in a groove 58 defined in the side wall of the milling drum housing 18. Electrical leads 60 connect the strain gage 54 to a controller 62. A cover plate (not shown) will typically cover the groove 58 to protect the strain gage 54 and the associated wiring 60 during operation.

As best seen in FIGS. 3 and 4, the strain gage 54 preferably has a longitudinal axis 64 which is oriented substantially vertically so that it will be substantially perpendicular to the ground surface 14, and is preferably located directly over and substantially intersects a rotational axis 66 of the milling drum 12.

It will be appreciated that it is not necessary for the strain gage 54 to be oriented exactly vertically, and it is not necessary for the strain gage 54 to be located directly over and have its axis 64 intersect the rotational axis 66. More generally speaking, the strain gage 54 should be oriented such that at least a majority portion of the force measured by the strain gage is oriented substantially perpendicular to the ground surface.

Because the loading of the reaction force against the working drum 12 across its width may not be uniform, it is preferable to have two such strain gages 54 and 56 mounted on opposite sides of the milling drum housing 18 adjacent opposite ends of the milling drum 12 so that the combined measurements of the strain gages 54 and 56 are representative of the entire reaction force acting upon the milling drum 12. It will be understood with regard to FIG. 2 that there are actually a large number of cutting teeth 24 engaging the ground surface 14 at any point in time. The reaction force sensors of the present invention are preferably reacting to the vertical component of the sum of all of the reaction forces acting upon all of the teeth which are engaged within the ground surface at any one point in time. One suitable strain gage that can be used for sensors 54 and 56 is the Model DA 120 available from ME-MeBsysteme GmbH of Hennigsdorf, Germany.

The controller 62 receives signals from the sensors 54 and 56 via electrical lines such as 60. The controller 62 comprises a computer or other programmable device with suitable inputs and outputs, and suitable programming including an operating routine which detects a change in the sensed parameter corresponding to an increase in reaction force and in response to that change sends controls signals via communication lines 68 and 70 to one or more actuators 72 and 74 to control the motive power provided to the advance drive such as 40 and 42. The actuators 72 and 74 may for example be electrically controlled valves which control the flow of hydraulic fluid to hydraulic drives 40 and 42 to control the advance speed of the machine 10.

If the controller 62 is controlling the rate at which the milling drum is lowered into the ground, the actuators 72 and 74 may be electrically controlled valves which control the flow of hydraulic fluid to the hydraulic rams which raise and lower the drum relative to the ground.

Figure 6:
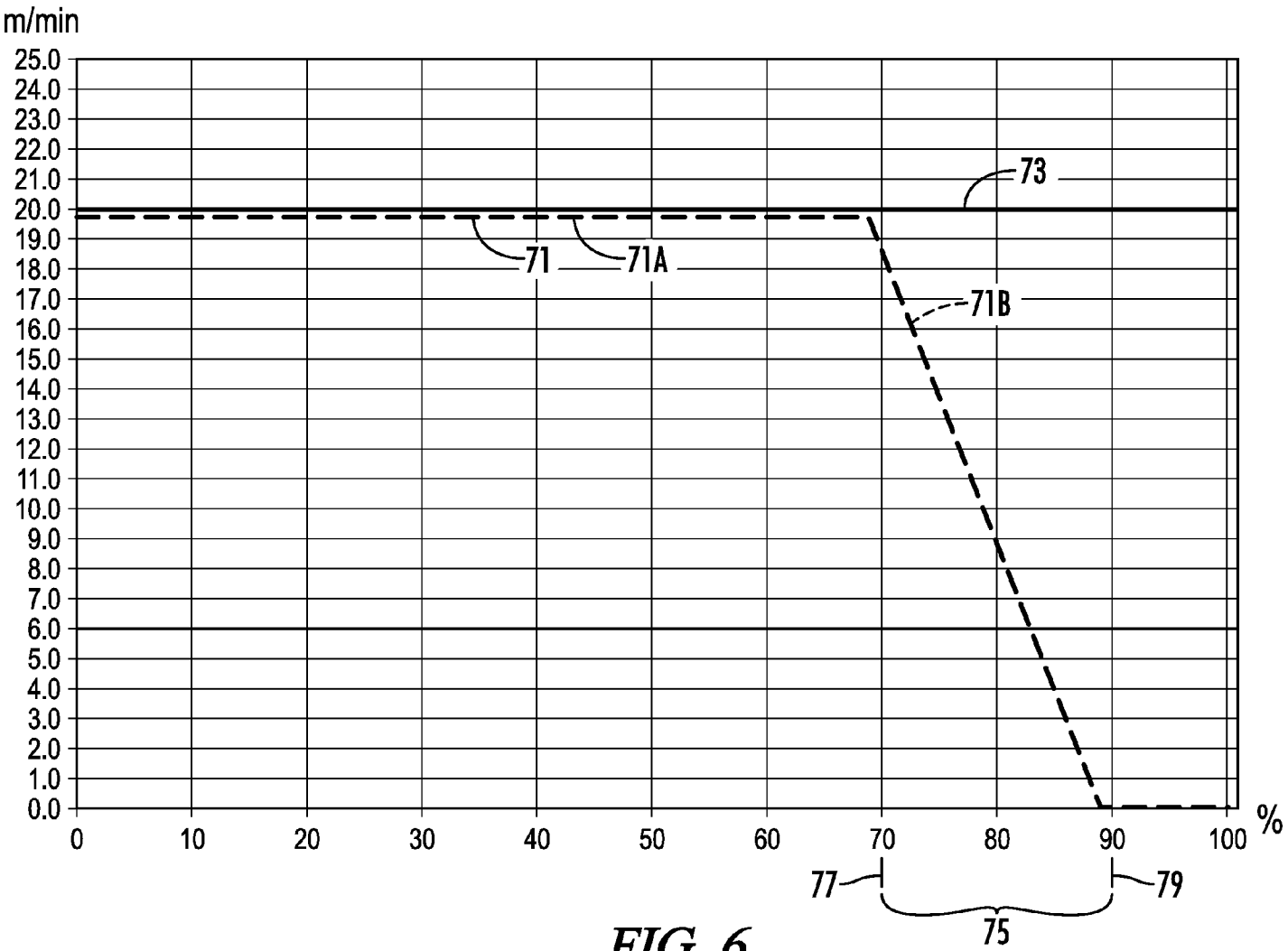
FIG. 6 is a graphical illustration showing one example of the manner in which the control system may reduce the advance speed of the construction machine based upon the sensed reaction force acting upon the milling drum. As shown by the dashed line the advance speed is reduced in a linear fashion within an operating range in which the reaction force on the milling drum increases from approximately 70% of the machine weight to approximately 90% of the machine weight. The solid line represents the set point for the desired advance speed of the machine.

FIG. 6 is a graphical representation of the relationship between advance speed and reaction force as implemented by an embodiment of the operating routine of the controller 62. In the embodiment illustrated in FIG. 6, the measured reaction force as a percentage of the total weight of machine 10 is represented on the horizontal axis and extends from 0% to 100%. A 0% reaction force represents the situation where the milling drum 12 is elevated completely above the ground surface 14. A 100% reaction force is representative of the situation where the entire weight of the machine 10 is resting on the milling drum 12 and none of that weight is being carried by the ground engaging supports such as 28 and 30.

The vertical scale on the left side of FIG. 6 represents the advance speed of the machine in meters per minute. The dashed line 71 represents the controlled advance speed of the machine 10 as controlled by an embodiment of the operating routine of the control system 62. The solid line 73 represents the set point for the advance speed selected by the operator. In the example shown the set point is 20.0 m/min.

In FIG. 6 an operating range 75 is defined between a low end 77 and a high end 79 along the horizontal axis. In the embodiment illustrated the low end 77 is approximately 70% and the high end 79 is approximately 90% of total machine weight. When the reaction force is less than the low end of the operating range, the advance speed of the machine 10 as represented by the horizontal portion 71A of the dashed line is approximately equal to the set point for advance speed selected by the operator of the machine. The set point is much like an automated speed control like a cruise control on an automobile by which the operator can select and have the control system maintain a desired constant speed.

The operating routine represented by FIG. 6, however, is designed to reduce the advance speed once the reaction force exceeds the low end 77 of the operating range.

A sloped portion 71B of the dashed line represents the desired reduction of advance speed of the machine 10 as controlled by the operating routine of control system 62. Line 71B represents a linear reduction. Other embodiments could use a non-linear reduction. As the detected reaction force continues to increase throughout the operating range 75 from approximately 70% to approximately 90%, the advance speed is linearly reduced from the set point speed represented by horizontal line portion 71A to zero. Thus, for example, if the detected reaction force is 80% as indicated on the horizontal axis, the advance speed is reduced to approximately one half of the set point speed. When the detected reaction force is equal to approximately 90% the advance speed is reduced to zero. At reaction forces above the high end of approximately 90%, the advance speed is maintained at zero.

In some instances when the reaction force rises to excessive levels near or above the high end 79 of the operating range 75 as seen in FIG. 6, it may be that even when the motive power applied to the advance drives 40 and 42 is reduced to zero, the forward driving forces applied to the ground surface 14 by the rotating milling drum 12 may still continue to push the machine forward. In such cases, the controller 62 may send a further control signal via control line 76 to a braking system 78 associated with one or more of the ground engaging supports 28 and 30. The controller 62 will direct the braking system 78 to apply a braking force to the ground engaging supports to further aid in retarding the advance speed of the machine 10.

In the embodiment of FIG. 6 the operating range 75 is illustrated for example as extending from a low end 77 of approximately 70% to a high end 79 of approximately 90%. It is noted that the range of 70% to 90% is only one example of a suitable operating range, and is not to be considered limiting. More generally, a preferred operating range may be described as having a low end of at least 50% of the weight of the construction machine, and a high end of less than 95% of the weight of the construction machine.

It will be understood that the dashed line 71 in FIG. 6 represents the behavior of the control system 62 and the target advance speed which it attempts to impose upon the machine 10. The dashed line of FIG. 6 does not represent the real life advance speed of the machine 10 which will be much more erratic.

The control system 52 and the operating routine of the controller 62 are preferably designed such that in normal operation of the machine 10, the reaction force acting upon the milling drum 12 will be maintained at about the low end 77 of the operating range 75 such as that illustrated in FIG. 6. This means that the machine 10 is operating at relatively high output near its maximum output, but is still under control. If the machine 10 was consistently operating below the low end 77 of the operating range 75 so that its advance speed remained constant below its set point, the machine 10 would be accomplishing less work than it is capable of doing. On the other hand, if the machine 10 were advancing so fast that the reaction force was frequently in excess of the low end 77 of the operating range 75, there would be an increased potential of lurch forward events.

Also it is noted that as with any control system, the set point cannot be maintained exactly and must be maintained within some acceptable range (which may be referred to as a deadband) about the set point. For example, in an embodiment where the control system attempts to maintain the reaction force at about the low end 77 of the range, and if the deadband is set at plus or minus 2%, the motive power will not be reduced until the advance speed reaches 72% and then the motive power will not be increased until the advance speed drops below 68%. Ideally the reaction force will be maintained within that deadband about the desired 70% operating point. Higher values of reaction force above the deadband are only reached if the properties of the ground surface change to a harder surface which may cause the reaction force to continue to rise in spite of a lowering of the motive power to the advance drive. It is the aim of an embodiment of the control system that the higher end 79 of the control range never be reached.

It is also noted that the linear relationship between advance speed and reaction force imposed by the controller 62 as represented by the line 71B in FIG. 6 is only one example of a control program. A non-linear control relationship of a progressive nature could also be used.

Figure 8:
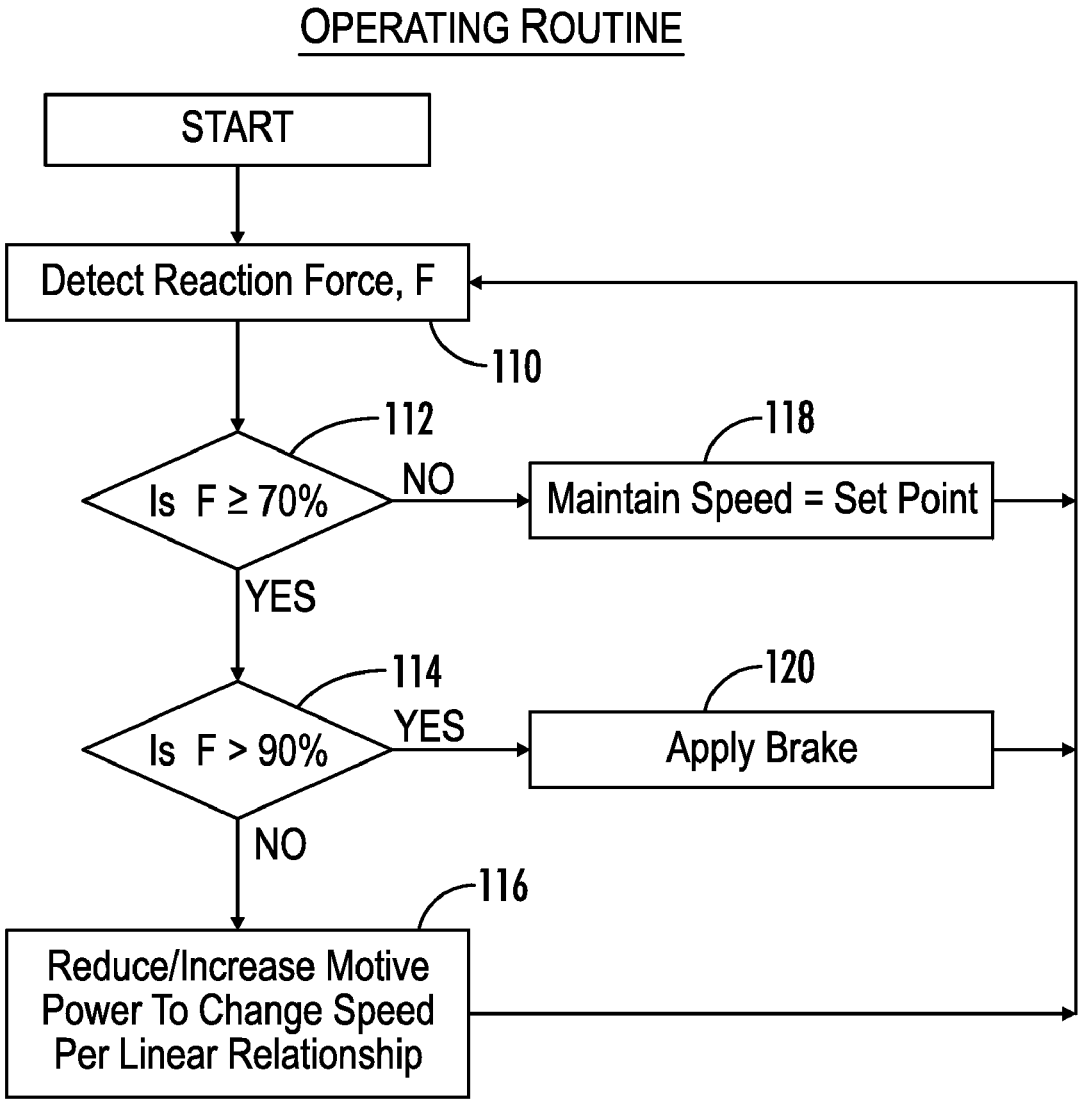
FIG. 8 is a flow chart outlining the operating routine used by the control system of FIG. 5.

FIG. 8 is a flow chart outlining the logic used in the basic operating routine carried out by controller 62. The reaction force acting on drum 12 will be detected on a frequent basis, as indicated at block 110. To implement the desired speed control as represented by dashed line 71 in FIG. 6, the routine will query whether that force is below the low end 77 of the range at block 112, or above the high end 79 of the range at block 114. If the reaction force is within the range 75, the motive power to supports 28 and 30 is controlled to control advance speed per the linear relationship between reaction force and advance speed shown by sloped line 71B in FIG. 6, as indicated at block 116. If the reaction force is below the low end 77, the advance speed is maintained at or near the set point speed, as indicated at block 118. If the reaction force is above the high end 79, the brake may be applied to further reduce advance speed as indicated at block 120.

Figure 7:
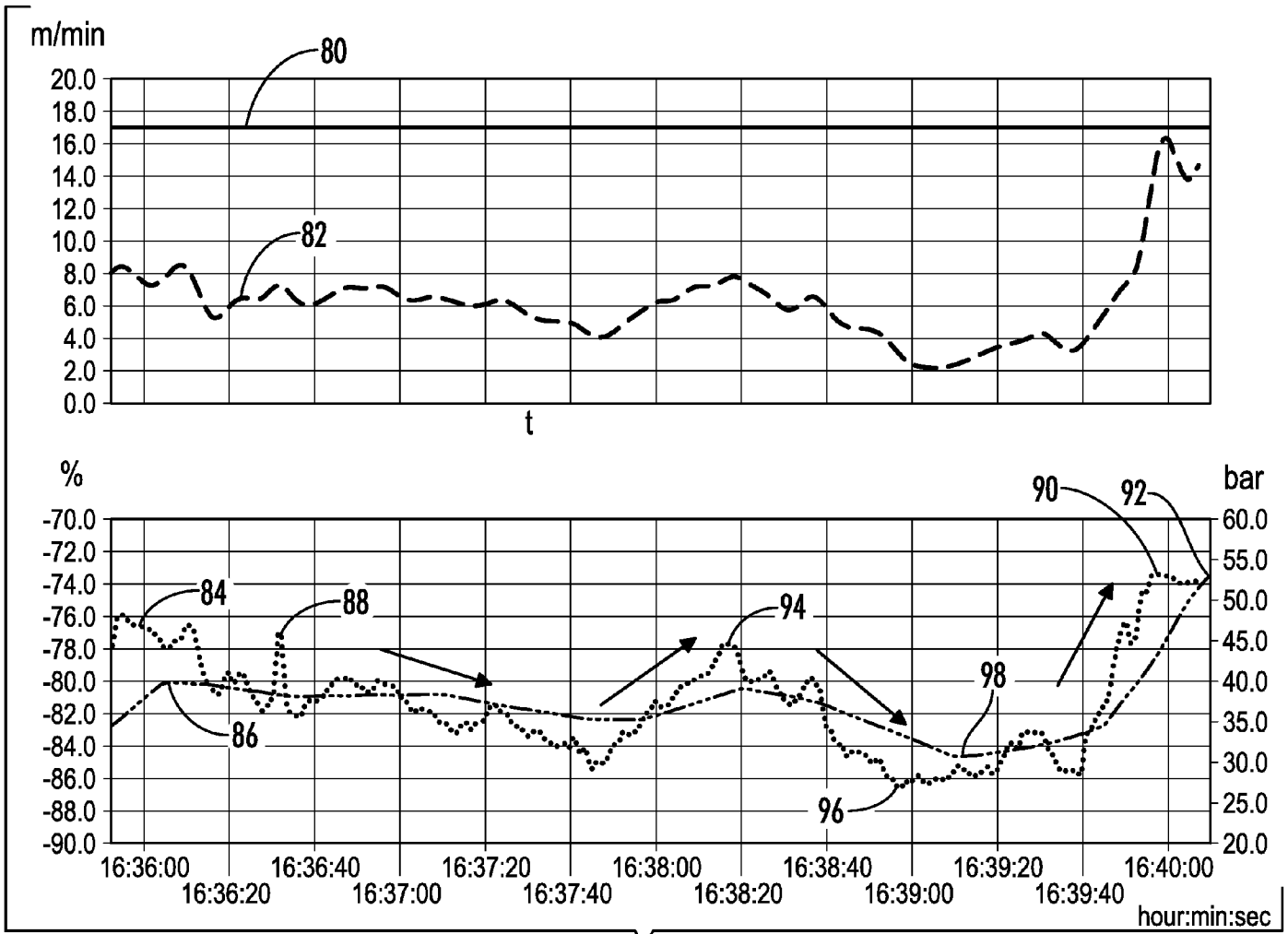
FIG. 7 is a graphical representation of data taken during actual operation of the control system. The upper portion of the graph shows actual measured advance speed as contrasted to a set point for advance speed. The lower portion of the graph shows in dotted lines the reaction force sensed by a strain gage sensor and contrasts that to the dot-dash line representing measurement of pressure changes within one of the hydraulic rams supporting one of the advance drives.

In FIG. 7, graphical data is shown representing an actual test of the machine 10, with the machine operating at an advance speed such that the detected reaction force was consistently within the operating range 75. The horizontal axis represents the chronological time during the test as shown along the bottom of FIG. 7. The solid line 80 in the upper portion of FIG. 7 represents the set point for advance speed, which in this example is approximately 17 m/min. The dashed line 82 represents the measured advance speed of the machine over the time interval represented on the horizontal axis at the bottom of FIG. 7.

In the lower portion of FIG. 7, the dotted line 84 represents the measured reaction force detected by the sum of the two strain gages 54 and 56. It is noted that the scale for the reaction force shown on the left hand side of the lower portion of FIG. 7 is inverted so a downwardly sloped line from left to right actually represents an increase in the measured reaction force, and an upwardly sloped dotted line from left to right actually represents a reduction in the measured reaction force. As can be discerned by comparing the general shape of the dotted line 84 representing the measured reaction force, to the dashed line 82 representing the measured advance speed, as the measured reaction force increases, the measured advance speed decreases. This occurs because the control system 62 is operating in accordance with the operating routine represented by FIG. 6 so as to impose an advance speed reduction upon the machine 10 as increased levels of reaction force are detected.

As can be seen from the dotted line 84, throughout the time interval of the test, the measured reaction force has remained within the operating range of 70 to 90% and thus throughout the test illustrated in FIG. 7 the control system 62 has been operating to apply varying reductions to the motive power directed to the advance drives 40 and 42 thereby allowing the machine 10 to operate at a high efficiency while still preventing lurch forward events.

Comparison to Pressure Sensing in Hydraulic Columns

One prior art approach to kick back control, as represented by U.S. Pat. No. 4,929,121 to Lent et al. and U.S. Pat. No. 5,318,378 to Lent, operates by measuring the pressure in one or more of the hydraulic columns which support the frame from the ground engaging supports.

During the test represented by FIG. 7, the two rear hydraulic supporting rams 34 of the test machine were set up as single acting rams and the supporting pressures within those rams were both measured and are collectively represented by the dot-dash line 86 in FIG. 7. The scale for the pressure measurements of line 86 is shown on the lower right hand side of FIG. 7 in bars. Two things are readily apparent when comparing the measured reaction force utilizing the present system as represented by the dotted line 84 to the measured hydraulic pressure in rams 34 represented by the dot-dash line 86.

First, the measurements of hydraulic pressure are much less responsive to reaction force changes of short duration. The pressure measurements tend to smooth out the measurement of load changes and they simply do not show rapid changes of short duration. For example, running from about time 16:36:10 to 16:37:40 it is seen that the dotted line 84 is generally trending down with many very short duration up and down events throughout the time interval. The dot-dash line 86, on the other hand, also trends downwardly but the events of short time duration are completely erased. For example, a peak like that shown at point 88 on line 84 of relatively short duration of approximately 5 seconds, has no apparent effect at all on the dot-dash line 86. Thus it is seen that the control system 62 of the present invention can react much more rapidly and to much shorter duration events than can a system operating based upon measured pressure in the hydraulic columns.

Second, the hydraulic pressure measurements represented by dot-dash line 86 are time shifted in their response. Thus even reaction force changes which are of long enough duration to be reflected in the measured pressures of line 86 are not recorded until some substantial time after the event has actually occurred. For example, looking near the right hand end of FIG. 7, a substantial, relatively rapid increase in the reaction force shown by line 84 occurs between the time 16:39:40 and 16:40:00 resulting in a peak 90 being reached at about time 16:39:55. Yet the pressures measurements represented by dot-dash line 86 do not reach this same level until about time 16:40:10 as represented at point 92. Thus there is a time delay of 10 to 15 seconds between the peak reaction force as measured by the present system shown on line 84 and the later peak reaction force as measured as a hydraulic pressure change in the hydraulic rams as shown by line 86.

A similar time delay can be seen by comparing the portion of dotted line 84 between time 16:38:15 beginning at about point 94 to 16:38:55 ending at about point 96. Looking at the dot-dash line 86 for the same time interval, it is seen that it is also trending in the same direction but it does not reach its lowest point 98 until about time 16:39:10 which again represents about a 15 second delay in response time.

Thus it is apparent that the present system is much more sensitive to measuring reaction force changes of short duration than is a system based upon measuring hydraulic pressure in the supporting rams. The present system also responds more quickly to all reaction force changes. This allows the present system to react more quickly and actually prevent lurch forward events whereas systems like those of the prior art can only detect events after they have already occurred.

There are believed to be several reasons why the present system reacts more quickly to changes in reaction force than does a system based upon measuring pressure in the hydraulic rams supporting the frame.

A first reason is mass inertia. For a system which measures changes in hydraulic pressure in the rams supporting the frame, substantially the entire construction machine 10 must move in order to affect the pressure in the rams. In contrast, sensors like sensors 54 and 56 measure changes in the force applied by the milling drum 12 directly on the milling drum housing 18 and thus do not have to be transmitted through the frame to actually lift the machine 10. Thus only the milling drum needs to react within the machine housing, rather than the entire machine 10 reacting, which provides much less mass inertia to the physical movement necessary to cause the sensors to react.

Second, there is a substantial damping factor due to friction with the rams 32 and 34 and the telescoping housings 36 and 38. In regard to this frictional damping one must also consider the concept of stick friction versus glide friction. As is known, it takes a greater force to initially overcome the friction within the rams 32 and 34 and the cylindrical housing 36 and 38 than it does to continue the movement necessary to reflect increasing pressure changes. Thus relatively small changes in reaction force may not be sufficient to overcome the stick friction presented by the rams and their cylindrical housings, and thus those relatively small changes will never be seen at all in the pressure measurements within the rams.

A third factor is the physical deformation of the rams 32 and 34 and their cylindrical housings 36 and 38 which occurs when heavy working loads are applied to the machine 10. It must be recalled, that the present system is designed to operate with the reaction force at a relatively high level in a range such as for example from 70 to 90% of the total weight of the machine 10. This occurs when the machine 10 is being pushed forward at near its maximum capability. Due to the geometry of the machine 10 and the vertical support rams 32 and 34 it will be appreciated that when the machine 10 is pushing forward under heavy loads there will be physical bending of the cylindrical housings 36 and 38 which will substantially increase the friction present in those components and further reduce their ability to faithfully and rapidly reflect changes in reactive force as varied pressures within the rams and play between rams and their housing.

Another difficulty with utilizing pressure measurements in the hydraulic rams to determine changes in reactive force loading of the milling drum is that such pressure measurements can only reliably be made from a single acting hydraulic ram. However, with construction machines like construction machine 10, it is typically necessary that at least the front or rear rams be double acting rams to allow for proper control of the stance of the machine 10 upon the ground surface 14. Thus the pressure data from hydraulic rams will typically come from only the front or rear rams. Because the changes in reaction force may not be reflected equally in the front and rear of the machine, a system based on measuring changes in pressure in the supporting rams at only the front or rear will be less accurate than a system which measures the reaction force at a location adjacent the working drum 12 itself. Thus the system of the present invention having sensors 54 and 56 generally directly above and on opposite sides of the milling drum 12 can react to the entire load change on the milling drum, whereas a system based upon measurement of pressure changes in either a forward or rearward supporting cylinder may not see the entire change which occurs at the milling drum.

Alternative Forms of Sensors

Load Cells

Although in the embodiment described above the sensors 54 and 56 each comprise a strain gage such as illustrated in FIGS. 3 and 4, each of the sensors 54 or 56 may alternatively comprise a load cell.

A load cell is an electronic device, i.e. a transducer, that is used to convert a force into an electrical signal. This conversion is indirect and happens in two stages. For a mechanical arrangement, the force being sensed typically deforms one or more strain gages. The strain gage converts the deformation, i.e. strain, into electrical signals. A load cell usually includes four strain gages such as in a Wheatstone bridge configuration. Load cells of one or two strain gages are also available. The electrical signal output is typically on the order of a few millivolts and often requires amplification by an instrumentation amplifier before it can be used. The output of the transducer is plugged into an algorithm to calculate the force applied to the load cell.

Although strain gage type load cells are the most common, there are also other types of load cells which may be used. In some industrial applications, hydraulic or hydrostatic load cells are used, and these may be utilized to eliminate some problems presented by strain gage based load cells. As an example, a hydraulic load cell is immune to transient voltages such as lightning and may be more effective in some outdoor environments.

Still other types of load cells include piezo-electric load cells and vibrating wire load cells.

Strain Gages on the Frame

In another alternative embodiment sensors like the sensors 54 and 56 may be located upon the frame 16 rather than upon the milling drum housing 18. A location of such a sensor 54A is schematically shown in FIG. 1. Such sensors would preferably be constructed in a manner similar to the sensors 54 and 56 previously described, and preferably would be located directly above the milling drum 12 and oriented in a manner similar to that described for sensors 54 and 56 above.

Bending Strain Gages

In a second alternative, strain gage type sensors such as 54B' and/or 54B" could be located upon the frame 16 and could be oriented so as to measure bending of the frame 16. Thus in FIG. 1, a first sensor 54B' is shown located on the frame 16 at a location between the milling drum and the forward support 28, and a second sensor 54B" is shown located on the frame 16 between the milling drum and the rearward support 30. The sensors 54B' and 54B" may be wire strain gage type sensors similar to that described above for the sensors 54 and 56. In this instance, the sensors may be oriented lengthwise substantially parallel to the ground surface 14 so as to be more reactive to bending stresses present in the frame 16. It will be further understood that the sensors 54B' and 54B" may be oriented in any desired manner and need not be parallel to the ground surface 14. Furthermore, the sensors 54B' and 54B" may comprise a plurality of strain gages such as in a bridge arrangement, or any other desired arrangement. Furthermore, there will preferably be one or more additional sensors on the opposite side of the frame 16 so that preferably sensors are placed in similar arrangements on opposite sides of the machine 10 so as to fully reflect changes in loading upon the entire width of the milling drum 12.

Bearing Load Sensors

One further alternative manner of detecting changes in reaction force is to utilize sensors 54 and 56 which are in the form of bearing load sensors. For example as schematically illustrated in FIG. 9 the milling drum 12 is typically mounted within the milling drum housing 18 within first and second bearings 150 and 152 located near opposite axial ends of the milling drum 12.

Figure 9:
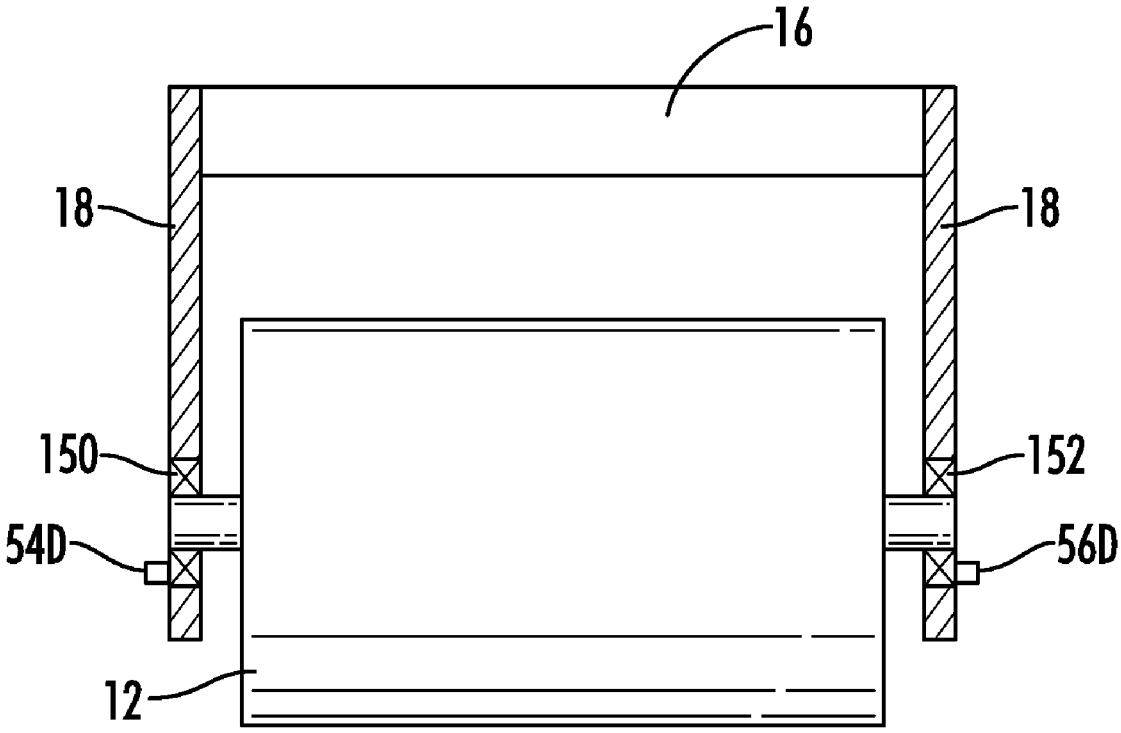
FIG. 9 is a schematic elevation view of the milling drum with a bearing load sensor.

The bearings 150 and 152 may incorporate integral load sensors such as 54D and 56D schematically illustrated in FIG. 9. Several designs are known for integral load sensors in bearings such as shown for example in U.S. Pat. No. 6,170,341; U.S. Pat. No. 6,338,281; U.S. Pat. No. 6,407,475; and U.S. Pat. Appl. Publ. 2008/0199117.

Backup Sensor Based Upon Support Ram Pressure Measurements

Additionally, although the present system is designed to prevent lurch forward events, it must be recognized that in some extreme situations the control system may not be completely successful in preventing such events, and a lurch forward event may actually occur. Thus it may be useful to provide a backup system such as a pressure sensor measuring hydraulic pressure within one or more of the supporting rams 32 or 34 which has been constructed to act in a single acting mode so that the supporting pressure is representative of the load being supported by that support ram.

Thus, a pressure sensor 100 as schematically illustrated in FIG. 5 may be located on the ram such as ram 34 to measure the pressures within that ram. The pressures within the ram 34 would for example be expected to look like the inverse of dot-dash line 86 of FIG. 7. Thus if a pressure decrease within the ram 34 as measured by sensor 100 is detected to fall below some predetermined level, the control system 62 may implement further safety routines to completely halt the application of power to the milling drum 12 such as by activating a clutch 102 in the drive system to the milling drum 12.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art which changes are encompassed within the scope and spirit of the present invention as defined by the appended claims.

What is claimed is:

1. A method of controlling a construction machine having a frame, a milling drum supported from the frame for milling a ground surface, a plurality of ground engaging supports engaging the ground surface and supporting the frame, and an advance drive associated with at least one of the ground engaging supports to provide motive power to the at least one ground engaging support, the method comprising:

(a) operating the milling drum in a down cut mode;

(b) applying motive power to the advance drive and moving the construction machine forward at an advance speed;

(c) sensing a parameter corresponding to a reaction force acting on the milling drum;

(d) detecting a change in the sensed parameter corresponding to an increase in the reaction force; and (e) in response to detecting the change in step (d), and while continuing to operate the milling drum in the down cut mode, reducing the motive power provided to the advance drive to reduce the advance speed and thereby reducing the reaction force and preventing a lurch forward event.

2. The method of claim 1, wherein:

step (e) further comprises applying a braking force to at least one of the ground engaging supports.

3. The method of claim 1, wherein:

step (e) further comprises preventing the advance speed of the construction machine from exceeding a selected operating speed.

4. The method of claim 1, the construction machine including a milling drum housing supporting the milling drum from the frame wherein:

in step (c) the sensed parameter comprises an output from at least one strain gage located on either the frame or the milling drum housing.

5. The method of claim 4, wherein:

in step (c) the at least one strain gage is oriented so that the sensed parameter corresponds to a component of the reaction force oriented substantially perpendicular to the ground surface.

6. The method of claim 5, wherein:

in step (c) the at least one strain gage is oriented substantially perpendicular to the ground surface.

7. The method of claim 4, wherein:

in step (c) the sensed parameter comprises outputs from at least two strain gages located on opposite sides of the frame or the milling drum housing.

8. The method of claim 1, wherein:

in step (c) the sensed parameter comprises an output from a load cell operatively associated with the frame and the milling drum.

9. The method of claim 1, further comprising:

sensing a pressure in a hydraulic ram connecting one of the ground engaging supports to the frame; and stopping operation of the milling drum if the sensed pressure on the hydraulic ram falls below a predetermined value.

10. The method of claim 1, wherein:

in step (c) the sensed parameter comprises an output from at least one strain gage located on the frame and sensing a bending of the frame.

11. The method of claim 1, wherein:

in step (c) the sensed parameter comprises a load in at least one bearing rotatably supporting the milling drum from the frame.

12. The method of claim 1, wherein:

step (d) further comprises detecting whether the reaction force is within an operating range defined as a range of percentages of weight of the construction machine, the range defined by a low end greater than 0% and a high end less than 100%; and step (e) further comprises reducing the advance speed only if the reaction force is within or above the operating range.

13. The method of claim 12, wherein:

step (e) further comprises reducing the advance speed in linear proportion to the reaction force throughout the operating range.

14. The method of claim 12, wherein:

step (e) further comprises reducing the motive power to the advance drive to zero if the reaction force is equal to or greater than the high end of the operating range.

15. The method of claim 12, wherein:

in step (d) the low end is at least 50% and the high end is no greater than 95%.

16. A construction machine, comprising:

a frame;

a milling drum supported from the frame for milling a ground surface, the milling drum constructed to operate in a down cut mode;

a plurality of ground engaging supports supporting the frame from the ground surface;

an advance drive associated with at least one of the ground engaging supports to provide motive power to advance the construction machine across the ground surface;

at least one sensor arranged to detect a parameter corresponding to a reaction force from the ground surface acting on the milling drum;

an actuator operably associated with the advance drive to control the motive power output by the advance drive; and a controller connected to the sensor to receive an input signal from the sensor, and connected to the actuator to send a control signal to the actuator, the controller including an operating routine which detects a change in the sensed parameter corresponding to an increase in reaction force and in response to the change reduces motive power provided to the advance drive to aid in preventing a lurch forward event of the construction machine.

17. The construction machine of claim 16, further comprising:

a braking system connected to one or more of the ground engaging supports; and wherein the controller is also connected to the braking system, and the operating routine additionally directs the braking system to apply a braking force to aid in preventing the lurch forward event.

18. The construction machine of claim 16, wherein:

the sensor comprises at least one strain gage.

19. The construction machine of claim 18, wherein:

the at least one strain gage has a gage axis oriented such that at least a majority portion of force measured by the strain gage is oriented perpendicular to the ground surface.

20. The construction machine of claim 18, wherein:

the at least one strain gage is located on the frame.

21. The construction machine of claim 20, wherein:

the at least one strain gage further comprises at least two strain gages on opposite sides of the frame.

22. The construction machine of claim 18, further comprising:

a milling drum housing supporting the milling drum from the frame; and wherein the at least one strain gage is located on the milling drum housing.

23. The construction machine of claim 22, wherein:

the at least one strain gage further comprises at least two strain gages on opposite sides of the milling drum housing.

24. The construction machine of claim 16, wherein the sensor comprises at least one load cell.

25. The construction machine of claim 16, wherein:

the sensor comprises at least one strain gage attached to the frame and oriented to detect a bending of the frame.

26. The construction machine of claim 16, wherein:

the sensor comprises at least one bearing load sensor.

27. The construction machine of claim 16, wherein:

the operating routine of the controller detects whether the reaction force is within an operating range extending from a low end to a high end, and the operating routine reduces motive power to the advance drive if the reaction force is within the operating range.

28. The construction machine of claim 27, wherein:

the operating routine reduces the motive power to zero if the reaction force is equal to or above the high end of the operating range.

29. The construction machine of claim 27, wherein:

the operating routine reduces the motive power such that an advance speed of the machine is reduced in linear proportion to the reaction force throughout the operating range.

30. The construction machine of claim 27, wherein:

the low end of the operating range is at least 50% of a weight of the construction machine; and the high end of the operating range is less than 95% of the weight of the construction machine.

* * * * *